United States Patent [19]

Roes et al.

[11] Patent Number: 4,535,892

[45] **Date of Patent: * Aug. 20, 1985**

[54] MODULARIZED TICKET HANDLING SYSTEM FOR USE IN AUTOMATIC TICKET PREPARATION SYSTEM

[75] Inventors: John B. Roes, San Diego; Guy M. Kelly, La Jolla; Robert F. Case; Chandler R. Deming, both of San Diego, all of Calif.

[73] Assignee: Cubic Western Data, San Diego, Calif.

[ * ] Notice: The portion of the term of this patent subsequent to May 3, 2000 has been disclaimed.

[21] Appl. No.: 455,756

[22] Filed: Jan. 5, 1983

Related U.S. Application Data

[62] Division of Ser. No. 211,022, Dec. 1, 1980, Pat. No. 4,381,705.

[51] Int. Cl.[3] ..... B07C 3/16

[52] U.S. Cl. ..... 209/3.3; 101/2; 209/569; 235/384; 235/477; 235/480

[58] Field of Search ..... 209/3.3, 569, 583; 101/2, 66, 69; 235/384, 475–477, 480, 481; 346/22, 24, 79, 97; 360/88; 364/475

[56] References Cited

U.S. PATENT DOCUMENTS

| | | | |
|---|---|---|---|
| 3,051,953 | 8/1962 | Shepard, Jr. | 346/24 |
| 3,501,622 | 3/1970 | Weir et al. | 235/384 |
| 3,508,032 | 4/1970 | MacDuffee et al. | 400/105 |
| 3,641,931 | 2/1972 | Hickox et al. | 101/93 C |
| 3,735,095 | 5/1973 | Mutz et al. | 209/569 X |
| 3,804,007 | 4/1974 | Arciprete et al. | 101/66 |
| 3,850,299 | 11/1974 | Kreitzer | 209/569 |
| 3,855,457 | 12/1974 | Amundson et al. | 209/569 X |
| 3,978,964 | 9/1976 | Kwan | 400/105 |
| 3,984,660 | 10/1976 | Oka et al. | 235/384 X |
| 4,020,325 | 4/1977 | Pfost et al. | 235/480 X |
| 4,040,345 | 8/1977 | Adams et al. | 101/66 |
| 4,064,804 | 12/1977 | Schweitzer | 101/451 |
| 4,073,585 | 2/1978 | Kobayashi et al. | 355/14 |
| 4,196,665 | 4/1980 | Rogers et al. | 101/66 |
| 4,197,797 | 4/1980 | Rayfield et al. | 101/66 X |
| 4,266,121 | 5/1981 | Hirose | 235/475 X |
| 4,277,061 | 7/1981 | Nagel et al. | 271/302 |
| 4,374,564 | 2/1983 | Miller et al. | 209/583 |
| 4,381,705 | 5/1983 | Roes et al. | 101/69 |

FOREIGN PATENT DOCUMENTS

| | | | |
|---|---|---|---|
| 2915720 | 10/1980 | Fed. Rep. of Germany | 400/104 |
| 807380 | 1/1959 | United Kingdom . | |
| 968596 | 9/1964 | United Kingdom . | |
| 1165140 | 9/1969 | United Kingdom . | |
| 1303651 | 1/1973 | United Kingdom . | |
| 1354368 | 5/1974 | United Kingdom . | |
| 1371382 | 10/1974 | United Kingdom . | |
| 1560313 | 2/1980 | United Kingdom . | |
| 2035644 | 6/1980 | United Kingdom . | |
| 1573082 | 8/1980 | United Kingdom . | |

OTHER PUBLICATIONS

IBM Technical Disclosure Bulletin–vol. 20, No. 5–Oct. 1977, pp. 1879–1880.

*Primary Examiner*—Randolph A. Reese
*Assistant Examiner*—Edward M. Wacyra
*Attorney, Agent, or Firm*—Brown, Martin & Haller

[57] ABSTRACT

A ticket handling system for use in a ticket preparation system that includes a signal processor for providing print signals to indicate information to be printed on the tickets and write signals to indicate information to be encoded on the tickets; a printer for printing information on ticket stock in response to the print signals; and a transducer for encoding information on the ticket stock in response to the write signals. The ticket handling system includes a feeder module including a feed system for feeding a strip of ticket stock; a cutter module; a cutting device for cutting ticket blanks of a given length from the fed end of the strip; a printer module including the printer for printing ticket information on the ticket blanks in response to the print signals; and a transport module including the transducer for encoding ticket information on the ticket blanks in response to the write signals.

9 Claims, 7 Drawing Figures

MODULARIZED TICKET HANDLING SYSTEM FOR USE IN AUTOMATIC TICKET PREPARATION SYSTEM

This is a division of application Ser. No. 211,022 filed Dec. 1, 1980, now U.S. Pat. No. 4,381,705.

CROSS-REFERENCE TO RELATED APPLICATIONS

This application is related to the following U.S. Patents filed on Dec. 1, 1980:

- U.S. Pat. No. 4,377,828 for "Ticket Transport" by Royal Carlton Moore, Jr., Charles Lee Hayman, and John B. Roes, Ser. No. 211,0283;
- U.S. Pat. No. 4,367,666 for "Ticket Stock Feed and Shear System" by John E. Toth, Ser. No. 211,028;
- U.S. Pat. No. 4,376,942 "Thermal Printing System" by John E. Toth, Wayne M. Spani, Chandler R. Deming, and Anthony W. Cumo, Ser. No. 211,025;
- U.S. Pat. No. 4,374,564 for "Ticket Diverter Module" by Gregory E. Miller and John E. Toth, Ser. No. 211,029;
- U.S. Pat. No. 4,459,527 for "Stepper Motor Control Circuit" by Charles Lee Hayman, Ser. No. 211,026;
- U.S. Pat. No. 4,416,378 for "Static Diverter Module" by Gregory E. Miller, Ser. No. 211,024; and
- U.S. Pat. No. 4,381,705 for "Modularized Ticket Handling System For Use In Automatic Ticket Processing System" by John B. Roes, Guy M. Kelly, Robert F. Case and Chandler R. Deming Ser. No. 211,021.
- U.S. Pat. No. 4,365,796 for "Ticket Exit Drive Module" issued to Gregory E. Miller.

BACKGROUND OF THE INVENTION

The present invention generally pertains to automatic ticket preparation systems, and is particularly directed to an improved ticket handling system for use in a ticket preparation system.

An automatic ticket preparation system typically includes a signal processor for providing print signals to indicate information to be printed on the tickets and write signals to indicate information to be encoded on the tickets, a printer for printing information on the ticket stock in response to the print signals and a transducer for encoding information on the ticket stock in response to the write signals. The ticket preparation system may further include a transducer for reading the encoded ticket and for providing a read signal in response thereto; and a verification circuit for comparing the read signal to the write signal and for providing a verification signal in response to the comparison. The signal processor is adapted for processing the verification signal and for providing control signals subsequent thereto to indicate whether the ticket is to be passed to an exit position where the ticket is accessible to a patron or to a capture position where the ticket is inaccessible to the patron.

The ticket handling system is that portion of the ticket preparation system that handles the ticket stock and creates the tickets. Prior art ticket handling systems include a large number of components in combination, whereby the installation of the ticket handling system in a ticket preparation system is complex and quite time consuming. Repairs of such prior art ticket handling systems likewise tend to be quite time consuming and result in lengthy interruptions in the operation of the ticket preparation systems while repairs are being made.

SUMMARY OF THE INVENTION

The present invention provides a modularized ticket handling system wherein a relatively small number of modules containing apparatus for performing basic ticket handling functions are mechanically interfaced with one another. As a result when a component of the ticket handling system malfunctions, the module containing the malfunctioning component can be readily and quickly replaced with a like module; whereby there will be only a short interruption in the operation of the ticket preparation system. The time consuming repair or replacement of the malfunctioning component then can be performed after the module has been removed from the system.

The basic functions necessary to the operation of a ticket handling system have been divided in accordance with the present invention to provide a combination of functional modules that are mechanically interfaced to provide an efficient ticket handling system that is easy to assemble and install in a short time. The basic ticket handling system of the present invention includes a feeder module including feed apparatus for feeding a strip of ticket stock; a cutter module including cutting apparatus for cutting ticket blanks of a given length from the fed end of the strip; and a transport module including the transducer for encoding ticket information on the ticket blanks in response to the write signals from the signal processor.

The functions performed by each module are selected so that the modules can be combined in a number of different combinations to satisfy particular requirements for different types of ticket handling systems. These different combinations also sometimes utilize additional functional modules, such as a diverter module and an exit module, and form various alternative preferred embodiments of the present invention.

When included in the ticket handling system, the diverter module is mechanically interfaced with the transport module and includes structure defining a capture passage for passing the ticket from the transport module to the capture position where the ticket is inaccessible to the patron. In some embodiments, the diverter module further includes structure defining an exit passage for passing the ticket from the transport module to the exit position where the ticket is accessible to the patron. In other embodiments, an exit module including structure defining such an exit passage, is mechanically interfaced with the transport module.

How these modules are combined and other features of the present invention are more fully discussed in the description of the preferred embodiments.

DESCRIPTION OF THE PREFERRED EMBODIMENTS

Figure 1:
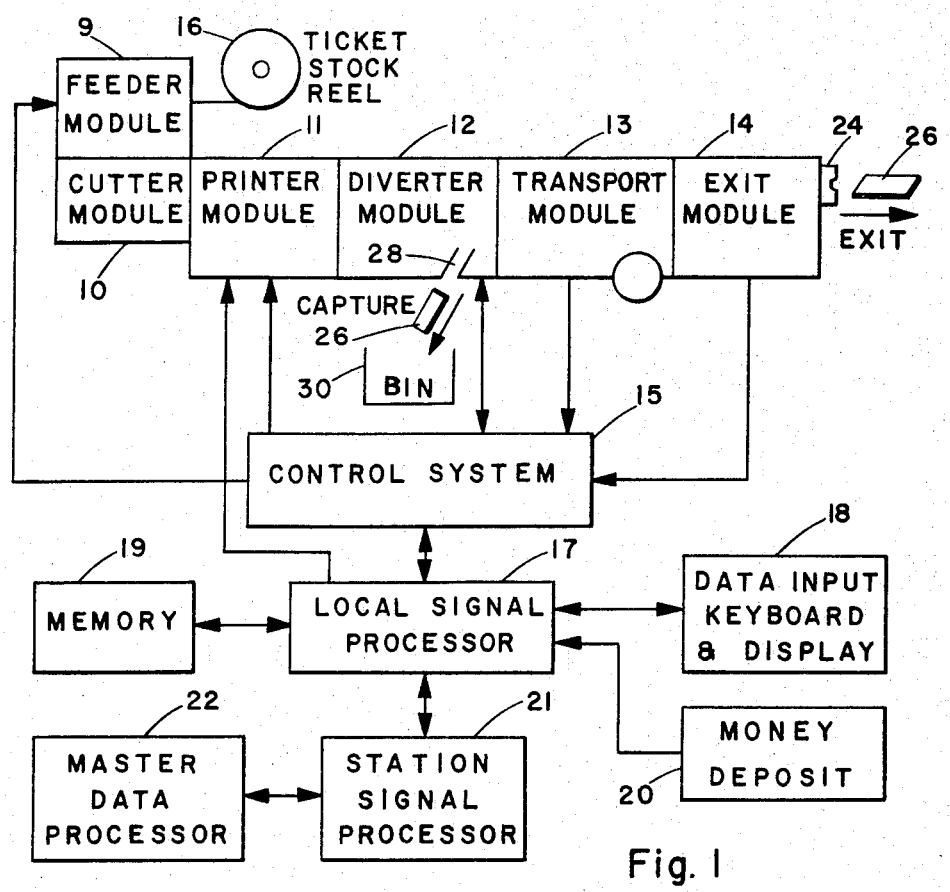
FIG. 1 is a block diagram illustrating a preferred embodiment of the ticket handling system of the present invention as included in an automatic ticket preparation system.

A preferred embodiment of the ticket handling system of the present invention is illustrated in FIG. 1 as being included in an automatic ticket preparation system for a mass transportation system having a plurality of stations at which tickets are sold and at which patrons board transportation vehicles. The ticket handling system includes a feeder module 9, a cutter module 10, a printer module 11, a diverter module 12, a transport module 13, an exit module 14, a control system 15, and a ticket stock reel 16.

There are a plurality of automatic ticket vending machines at each station. Each automatic ticket vending machine includes a ticket handling system in combination with a local signal processor 17, a data input keyboard and display 18, and a memory 19. Each of the automatic ticket vending machines is coupled to a station signal processor 21. There is only one station signal processor at each station. The station signal processors 21 at the different stations of the transportation system are all coupled to a single master data processor 22.

At a given station some of the automatic ticket vending machines are located so that they may be operated by patrons, and at least one automatic ticket vending machine is located for operation by a station attendant. Each of the automatic ticket vending machines that are located for operation by patrons includes a money deposit apparatus 20 for receiving money in different denominations or a charge card for enabling operation of the machine.

The data input keyboard 18 is operated to select a destination and thereby commences operation of the automatic ticket vending machine. The keyboard is operated to provide destination signals which are fed through the local signal processor 17 to the station signal processor 21. The station signal processor 21 contains a memory including fare tables and responds to the destination signal by producing a fare signal that is provided via the local signal processor 17 to the data input keyboard and display 18 to cause an indication of the fare to be displayed. In an automatic ticket vending machine, including a money deposit apparatus 20, such apparatus 20 is connected to the local signal processor 17 and provides a deposit signal through the local signal processor 17 to the station signal processor 21 to indicate the amount of money that has been deposited. When the deposit signal indicates deposit of at least the amount of money indicated by the fare signal, the station signal processor 21 provides a signal to the local signal processor 17 for enabling the ticket handling system.

The automatic ticket vending machine operated by the station attendant need not have a money deposit apparatus 20; but in lieu thereof, a switch (not shown) is provided for operation by the station attendant to enable the ticket handling system when the correct amount of money has been tendered by the patron.

The master data processor 22 provides signals to the station signal processor 21 for updating the fare tables and the various signal processing routines stored in the station signal processor 21.

The memory 19 is connected to the local signal processor 17 for storing data that must remain secure from accidental destruction and unauthorized access, such as running totals of money received by the money deposit apparatus 20, and the totals and values of tickets dispensed to patrons by the automatic ticket vending machine. The data stored in the memory 20, can be retrieved in response to signals from either the station signal processor 21 or the master data processor 22.

Once the ticket handling system is enabled, the control system 15 provides control signals to the feeder module 9, the printer module 11 and the transport module 13 for activating motors in such modules for driving transport systems therein for feeding the ticket stock from the reel 16, cutting ticket blanks therefrom, and transporting cut ticket blanks through the ticket handling system.

Operation of the ticket handling system commences with a strip of ticket stock 23 being fed from the ticket stock reel 16 by the feeder module 9. The cutter module 10 cuts a ticket blank of a given length from the strip 23 and feeds the cut ticket blank to the printer module 11.

The printer module 11 prints ticket information on the ticket blank in response to print signals received from the station signal processor 21 via the local signal processor 17. The printed, cut ticket blank is then transported through the diverter module 12 to the transport module 13.

The transport module 13 includes a transducer for encoding the printed, cut ticket blanks. The tickets prepared by this system preferably include a magnetic recording medium which is magnetically encoded to contain ticket information. The transducer encodes the ticket blanks in response to write signals received from all station signal processor 21 via the local signal processor 17 and the control system 15 to thereby create a printed, encoded ticket. The transducer then reads the encoded ticket and provides a read signal to a verification circuit located in the control system 15. The verification circuit compares the read signal to the write signal. If the read signal initially does not correspond to the write signal, the ticket is reencoded, and the ticket is again read to provide a new read signal. The new read signal is compared to the write signal. If the new read signal still does not correspond to the write signal, the ticket is reencoded for a third time and the comparison step is again repeated. This process of reencoding and comparing can be repeated any predetermined number of times, when the comparison fails to indicate a correspondence between the write signal and the read signal. It is preferred to limit the number of such repetitions to three. The verification circuit provides a verification signal either after a comparison in which the write signal corresponds to the second read signal, or after the repeated series of non-corresponding comparisons is completed. The verification signal indicates whether the read signal corresponds to the write signal. The verification signal is provided via the local signal processor 17 to the station signal processor 21. The station signal processor processes the verification signal to determine whether the ticket has been correctly encoded; and in response thereto provides a control signal to the transport module 13 to indicate whether the ticket is to be passed to an exit position 24, where the ticket 26 is accessible to a patron, or to a capture position 28, where the ticket 26 is inaccessible to the patron.

If the verification signal indicates that the ticket 26 was correctly encoded, the control signal from the station signal processor 21 indicates that the transducer in the transport module 13 is to transport the ticket to the exit position 24 in the exit module 14. The transport module 13 responds to such a control signal by transporting the ticket in a forward direction from the transport module 13 through the exit module 14 to the exit position 24, where the ticket 26 is accessible to the patron.

If the verification signal indicates that the ticket 26 was not correctly encoded, the control signal from the station signal processor 21 indicates that the transport module is to transport the ticket 26 to the capture position 28. The transport module 13 responds to such a control signal by transporting the ticket in a reverse direction back from the transport module 13 through the diverter module 12 to the capture position 28, where the ticket 26 is inaccessible to the patron. The ticket 26 drops from the capture position 28 into a bin 30, where incorrectly encoded tickets are accumulated. The ticket handling system then repeats the process to provide a ticket that is correctly encoded for delivery to the patron at the exit position 24.

The operations of the station signal processor 21 described above preferably are performed by the station signal processor 21 in an automatic ticket vending machine designed for operation by the station attendant. In automatic ticket vending machines designed for operation by patrons, these operations typically are performed by the local signal processor 17 instead of the station signal processor 21.

Figure 2:
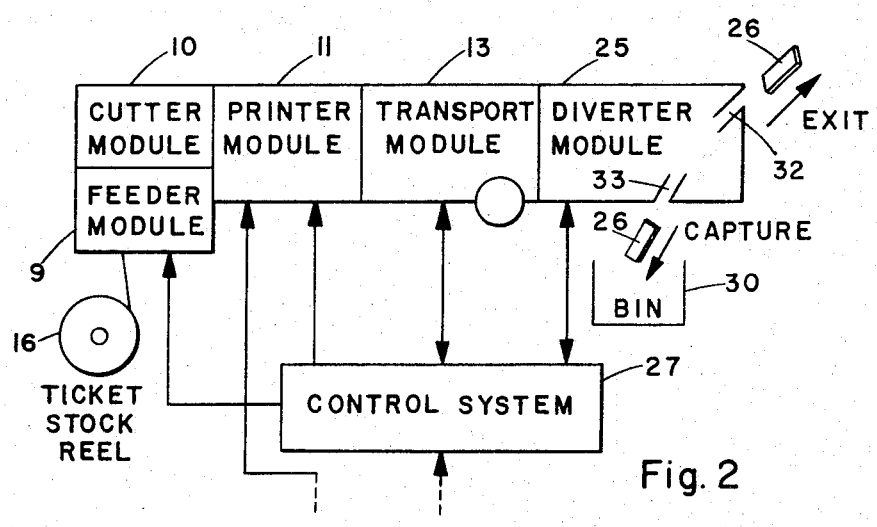
FIG. 2 is a block diagram illustrating an alternative preferred embodiment that may be included in the automatic ticket preparation system of FIG. 1.

FIG. 2 illustrates an alternative arrangement of the modules of the automatic ticket handling system for an automatic ticket preparation system. The automatic ticket handling system includes a feeder module 9, a cutter module 10, a printer module 11, a transport module 13, a diverter module 25, a control system 27 and a ticket stock reel 16; and is connected to the local signal processor 17, data input keyboard and display 18, memory 19, money deposit 20, station signal processor 21 and master data processor 22 in the same manner as shown in FIG. 1. The ticket handling system of FIG. 2 differs from the ticket handling system of FIG. 1 in the following respects. The diverter module 25 includes both an exit position 32 and a capture position 33 and replaces the exit module 14 of the system of FIG. 1. The diverter module 12 of the system of FIG. 1 is eliminated in the system of FIG. 2; and the transport module 13 is mechanically interfaced with and between the printer module 11 and the diverter module 25. The diverter module 25 includes a diverter for directing tickets passed from the transport module 13 to either the exit position 32 or the capture position 33. The control signal provided by the station signal processor 21 in response to processing the verification signal is provided to both the transport module transducer to cause erasure of information encoded on the ticket and the diverter module 25 to control the diverter to cause the ticket to be transported to either the exit position 32 or the capture position 33. A ticket transported to the exit position 32 is accessible to the patron. A ticket transported to the capture position 33 is inaccessible to the patron, and drops into a bin 30 where incorrectly encoded tickets are accumulated.

Systems for using tickets prepared with the ticket handling system of the present invention are described in the cross-referenced U.S. Pat. No. 4,381,705 issued to John B. Roes, Guy M. Kelly, Robert F. Case, and Chandler R. Deming for "Modularized Ticket Handling System For Use In Automatic Ticket Processing System".

The ticket handling system used in the ticket preparation system shown in FIG. 1, is described with reference to FIGS. 3, 4 and 6. In this ticket handling system, the diverter module 12 is mechanically interfaced with and between the printer module 11 and the transport module 13; the feeder module 9 is merchanically interfaced with the cutter module 10, the cutter module 10 is mechanically interfaced with the printer module 11; and the exit module 14 is mechanically interfaced with the transport module 13. The interfaced modules 9, 10, 11, 12, 13 and 14 include captive bolts (not shown) for coupling these modules to a supporting plate (not shown) in predetermined positions on the plate to effect the mechanical interfacing between the modules. The interfaced modules 11, 12, and 13 further include interlocking fingers 35 (FIG. 4) for coupling these modules so as to provide a continuous, aligned, unobstructed passage for the tickets from one module to another.

The feeder module 9 includes structure 37 defining a feed passage 38 for passing ticket stock 23 from the reel 16. A drive roller 39 and a corresponding pressure roller 40 are positioned adjacent the feed passage 38 for feeding the ticket stock 23 through the feed passage 38. The drive roller 39 is coupled to a feed motor 41 by a belt 42 and a pulley 43 and is driven by the feed motor 41.

The cutter module 10 includes a rotary blade 45 for cutting the strip of ticket stock 23 into ticket blanks of a given length. A cutter motor 46 is coupled to the rotary blade 45 by a bell crank 47 and thereby operates to rotate the blade 45 for cutting the strip of ticket stock 23.

The cutter module 10 includes structure 49 defining a passage 50 through which the strip of ticket stock is fed past the rotary blade 45 into the printer module 11. The printer module 11 includes pressure rollers 52 and corresponding drive rollers 51 for gripping the leading portion of the strip of ticket stock 23 before the strip of ticket stock 23 is cut by the rotary blade 45.

The cutter module also includes a photosensor 53 adjacent the passage 50 for sensing the passage of the trailing edge of the ticket blank through the passage 50. The photosensor 53 is coupled to the feed motor 41 for turning off the feed motor 41 in response to the photosensor 53 sensing the passage of the trailing edge of the ticket blank. A light emitting diode (LED) 54 is positioned opposite the photosensor 53 for providing a light beam to the photosensor 53 that is interrupted when a ticket blank passes between the LED 54 and the photosensor 53.

Preferred embodiments of the feeder module 9 and the cutter module 10 are more fully described in the cross-referenced U.S. Pat. No. 4,367,666 issued to John E. Toth for "Ticket Stock Feed and Shear System" the disclosure of which is incorporated herein by reference thereto.

In addition to the pressure rollers 52 and drive rollers 51, described above, the printer module 11 includes a printing head 55 for printing ticket information on the ticket blanks in response to the print signals from the station signal processor 21. A drive roller 56 is provided opposite the printing head 55 for transporting the ticket blank past the printing head 55.

The printer module 11 further includes a printer transport motor 57. The motor 57 is coupled to the drive rollers 51 and 56 by a belt 58 and pulleys 59, 60 and 61; and drives the drive rollers 51 and 56 for transporting the cut ticket blank through the printer module 11 past the printing head 55. The pulleys 59, 60 and 61 are attached to the axles 62, 63 and 64 of the motor 57 and the drive rollers 51 and 56 respectively.

A preferred embodiment of the printer module 11 is more fully described in the cross-referenced U.S. Pat. No. 4,376,942 issued to John E. Toth, Wayne M. Spani, Chandler R. Deming, and Anthony W. Cumo for "Thermal Printing System", the disclosure of which is incorporated herein by reference thereto.

The transport module 13 includes as a transducer a magnetic recording head 66 for encoding information on a cut, printed ticket blank in response to a write signal and for reading a magnetically encoded ticket and providing a read signal in response thereto. The transport module defines a transport passage 67 through which the ticket is transported past the transducer head 66.

The transport module 13 further includes a system of transport rollers, including drive rollers 69, 70, 71 and 72 and corresponding pressure rollers 73, 74, 75, and 76 for transporting a ticket blank through the transport passage 67 of the transport module 13. The transport roller system is bidirectional. A bidirectional driver motor 77 is coupled to the transport rollers by a belt 78 for driving the transport rollers. The belt 78 passes over idler rollers 79, drive roller pulleys 80, 81, 82 and 83 and a drive motor pulley 84. The drive roller pulleys 80 are attached to the axles 85, 86, 87 and 88 of the respective drive rollers 69, 70, 71 and 72.

A preferred embodiment of the transport module 11 is more fully described in the cross-referenced U.S. Pat. No. 4,377,828 issued to Royal Carlton Moore, Jr., Charles Lee Hayman, and John B. Roes for "Ticket Transport" and U.S. Pat. No. 4,459,527 issued to Charles Lee Hayman for "Stepper Motor Control Circuit", the disclosure of which are incorporated herein by reference thereto.

The diverter module 12 includes structure 90 defining a transport passage 91 for passing a ticket blank from the printer module 11 to the transport passage 67 of the transport module 13. The diverter module 12 also includes structure 92 defining a capture passage 93 for passing a ticket from the transport passage 67 of the transport module 13 to the capture position 28 where the ticket is inaccessible to the patron.

The diverter module 12 includes a flexible leaf diverter 94 secured within the capture passage 93 and extending to within the transport passage 91 for enabling a ticket blank to be passed in the forward direction into the transport module 13 and for diverting a ticket into the capture passage 93 when the ticket is passed in the reverse direction back from the transport module 13.

Figure 3:
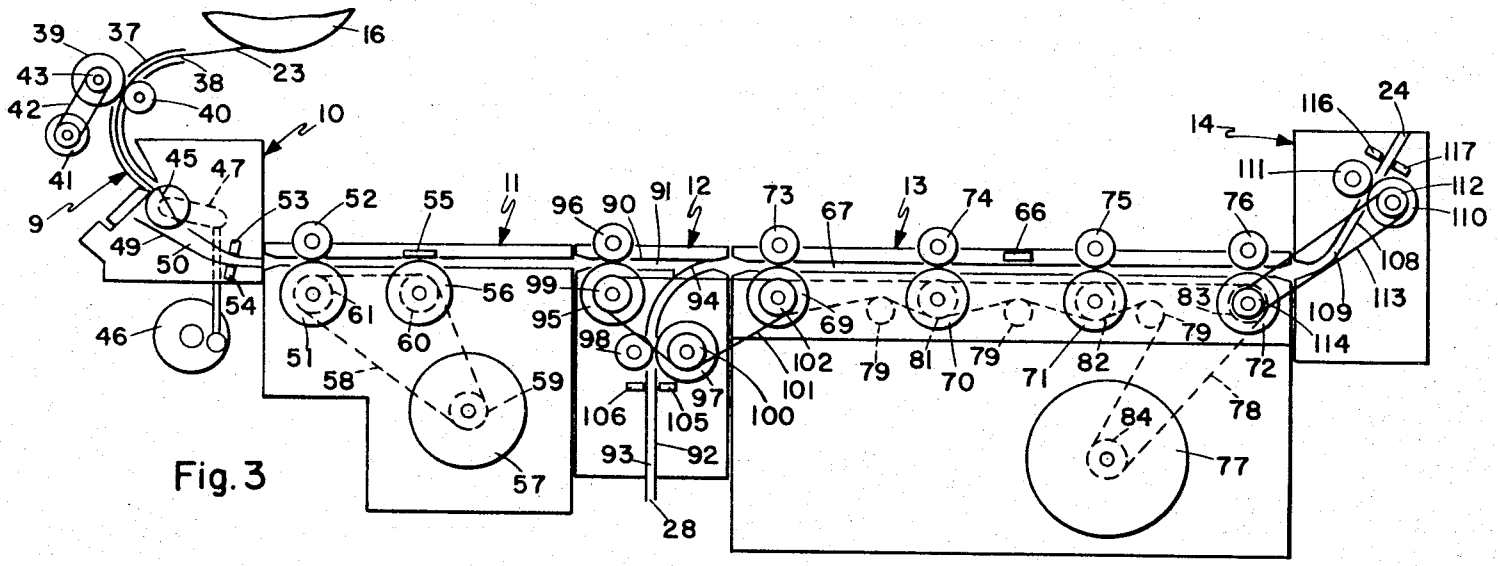
FIGS. 3 and 4 are respectively side and top elevation schematic views of the combination of modules forming the ticket handling system of FIG. 1.
Figure 4:
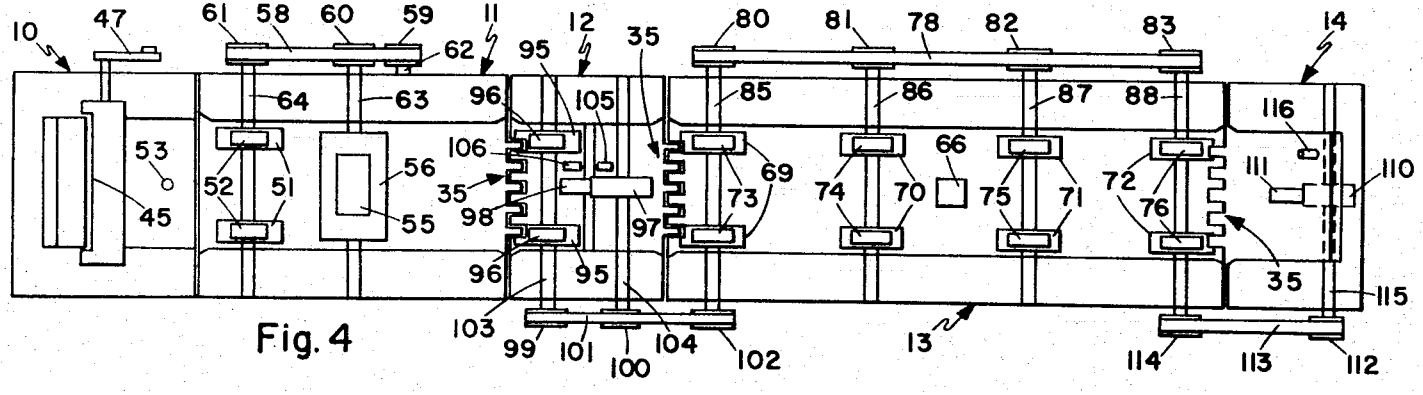

The diverter 94 normally is in the position shown in FIG. 3 for diverting the ticket into the capture passage 93. When a ticket blank is transported in the forward direction through the transport passage 91, the ticket blank pushes against the diverter 94 and pushes the diverter aside to enable the ticket blank to pass into the transport module 13.

The diverter module 12 includes transport drive rollers 95 and transport pressure rollers 96 for transporting the ticket through the transport passage 91. The diverter module 12 includes a transport drive roller 97 and a transport pressure roller 98 for transporting the ticket through the capture passage 93. The drive rollers 95 and 97 are coupled by pulleys 99 and 100, respectively, and a belt 101 to a pulley 102 on the shaft 85 of the transport rollers 69 of the transport module 13. The pulleys 99 and 100 are on the axles 103 and 104 of the drive rollers 95 and 97, respectively. Accordingly, the drive rollers 95 and 97 also are driven by the drive motor 77 of the transport module 13. When the drive motor 77 is driven in the forward direction, the rollers 95 and 96 can transport a ticket blank forward through the transport passage 91 toward the transport module 13; and when the drive motor 77 is driven in the reverse direction, the rollers 97 and 98 can transport a ticket back from the transport module 13 and through the capture passage 93 to the capture position 28.

The diverter module 12 includes a photosensor 105 positioned for sensing the passage of a ticket through the capture passage 93. The diverter module also includes an LED 106 positioned opposite the photosensor 105 for providing a light beam to the photosensor 105 that is interrupted when a ticket passes between the LED 106 and the photosensor 105.

A preferred embodiment of the diverter module 12 is described in the cross-referenced U.S. Pat. No. 4,416,378 issued to Gregory E. Miller for "Static Diverter", the disclosure of which is incorporated herein by reference thereto.

The exit module 14 includes structure 108 defining an exit passage 109 for passing a ticket from the transport passage 67 of the transport module 13 to the exit position 24 where the ticket is accessible to the patron.

The exit module 14 includes a transport drive roller 110 and a transport pressure roller 111 for transporting the ticket through the exit passage 109 to the exit position 24. The drive roller 110 is coupled by a pulley 112 and a belt 113 to a pulley 114 on the axle 88 of the drive rollers 72 of the transport module 13. The pulley 112 is on the axle 115 of the drive roller 137. Accordingly, the drive roller 110 is driven by the drive motor 77 of the transport module 13.

The exit module 14 includes a photosensor 116 positioned for sensing the passage of a ticket through the exit passage 109 of the exit module 14. The exit module 14 also includes an LED 117 positioned opposite the photosensor 116 for providing a light beam to the photosensor 116 that is interrupted when a ticket passes between the LED 117 and the photosensor 116.

A preferred embodiment of the exit module 14 is described in the cross-referenced U.S. Pat. No. 4,365,796 issued to Gregory E. Miller for "Ticket Exit Drive Module", the disclosure of which is incorporated herein by reference thereto.

The control system 15 includes a feed control circuit 119, a printer transport circuit 120, a drive control circuit 122 and a transducer control circuit 123. These circuits may be located separate from the respective modules containing the components that they control (as shown in FIG. 6), or they may be located in such modules. For example, the feed control circuit 119 can be located in the feeder module 9; the printer transport control circuit 120 can be located in the printer module 11; and/or the drive control circuit 122 and/or the transducer control circuit 123 can be located in the transport module 13.

Figure 6:
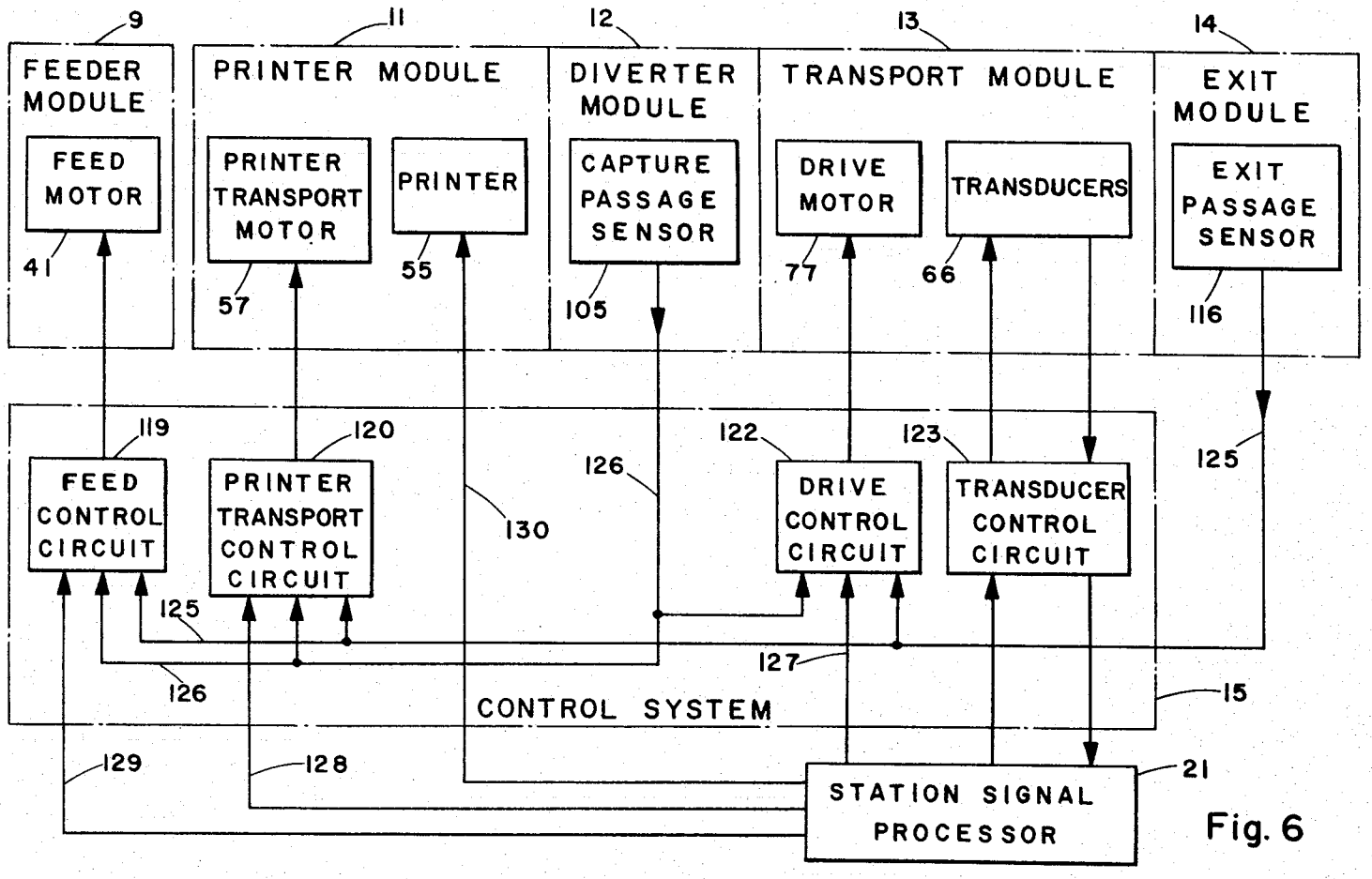
FIG. 6 is a block diagram of that portion of the electrical system of the ticket handling system of FIG. 1 that pertains to the functional coopertion between the different modules of such ticket handling system and with the signal processor.

The control system 15 is shown in FIG. 6 as connected directly to the station signal processor 21 although such connection preferably is made through the local signal processor 17.

The drive control circuit 122 controls the operation of the drive motor 77 in the transport module 13. The drive control circuit 122 receives signals on line 125 from the exit passage sensor 116 in the exit module 14; on line 126 from the capture passage sensor 105 in the diverter module 12; and on line 127 from the station signal processor 21.

The printer transport control circuit 120 controls the operation of the printer transport motor 57 in the printer module 11. The printer transport control circuit 120 receives signals on line 125 from the exit passage sensor 116 in the exit module 14; and on line 126 from the capture passage sensor 105 in the diverter module 12; and on line 128 from the station signal processor 21.

The feed control circuit 119 controls the operation of the feed motor 41 in the feeder module 9. The feed control circuit receives signals on line 125 from the exit passage sensor 116 in the exit module 14; on line 126 from the capture passage sensor 105 in the diverter module 12; and on line 129 from the station signal processor 21.

The transducer control circuit 123 controls the operation of the transducer 66 in response to signals from the station signal processor 21. The transducer control circuit 123 also provides the write signal from the station signal processor 21 to the transducer head 66; compares the write signal to the read signal; and provides the verification signal to the station signal processor 21 as discussed above with relation to FIG. 1. The particular operation of transducer control circuit 123 will be apparent to those skilled in such art; and an understanding of such operation is not necessary to an understanding of the present invention.

The operation of the ticket handling system of FIG. 6 for a ticket preparation system commences when the feed control circuit 119, the printer transport control circuit 120 and the drive control circuit 122 turn on the feed motor 41, the printer transport motor 57 and the drive motor 77 in response to start signals on lines 129, 128 and 127, respectively, from the station signal processor 21. All these motors 41, 57, 77 initially operate to drive the respective transport systems to which they are coupled so as to transport the ticket stock strip, the ticket blanks and ticket in a forward direction toward the exit module 14. The feed motor 41 turns off after the cut ticket blank has been fed from the cutter module 10. The printer transport motor 57 is turned off after the printed cut ticket blank has been transported from the printer module 11. Once they have been so turned off, these two motors 41, 57 cannot be turned on again in response to signls on lines 129 and 128 to their respective control circuits 119, 120 until after the control circuits 119, 120 have received an enabling signal on either line 125 from the exit passage sensor 116 or on line 126 from the capture passage sensor 105 indicating that the ticket has either passed through the exit passage 109 of the exit module 14 and been retrived by a patron or has passed through the capture passage 93 of the diverter module 12 into the bin 30. This prevents the ticket handling system from becoming jammed by attempting to print and encode more than one ticket at a time.

The printer 55 prints ticket information on the cut ticket blank in response to print signals on line 130 from the station signal processor 21.

With the drive motor 77 initially operating in the forward direction, the printed ticket blank is transported in the forward direction past the transducer head 66 and the ticket is magnetically encoded in response to the write signal from the station signal processor 21.

The ticket is then transported past the transducer head 66 again, and the magnetically encoded signal on the ticket is read by the transducer head 66 to provide a read signal that is provided to the verification circuit in the transducer control circuit 123 and compared to the write signal to thereby produce a verification signal that is provided to the station signal processor 21. It is necessary to transport the ticket back and forth past the transducer head 66, and the station signal processor 21 provides signals on line 127 to the drive control circuit 122 to cause the drive motor 77 to be driven in the desired direction for prescribed intervals.

After the signal processing by the station signal processor 21 subsequent to the receipt of the verification signal is completed, the station signal processor 21 provides a signal on line 127 to the drive control circuit 122 to cause the ticket to be transported either in the forward direction from the transport module 13 into the exit passage 109 of the exit module 14 to the patron, or in the reverse direction from the transport module 13 into the capture passage 93 of the diverter module 12 when the ticket is to be captured.

When the ticket is diverted into the exit passage 109, it is gripped by the transport drive roller 110 and transport pressure roller 111 and transported to the exit position 24, where it may be retrived by the patron.

When the ticket is diverted into the capture passage 93, it is gripped by the transport drive roller 97 and the transport pressure roller 98 and transported toward the capture position 28, and is discharged into the bin 30.

When the ticket is removed from the exit position 24, it completes its passage through the exit passage 109 in the exit module 14, and the sensor 116 provides a signal on line 125 to the feed control circuit 119, the printer transport control circuit 120, and the drive control circuit 122 indicating that the ticket has passed through the exit passage 109 from the transport module 13.

When the ticket passes from the capture position 28, it completes its passage from the capture passage 93 in the diverter module 12 and the sensor 105 provides a signal on line 126 to the feed control circuit 119, the printer transport control circuit 120 and the drive control circuit 122 indicating that the ticket has passed through the capture passage 93 from the transport module 13.

As noted above, the feed control circuit 119 and the printer transport control circuit 120 receive an enabling signal on either line 125 or 126 indicating the passage of the ticket through either the exit passage 109 or the capture before being enabled to drive their respective motors 41, 57 in response to another start signal on lines 129 and 128 from the station signal processor 21.

The drive control circuit 122 responds to a signal on either line 125 or 126 indicating the passage of the ticket through either the exit passage 109 or the capture passage 93 by turning off the drive motor 77.

The ticket handling system is again ready for the preparation of another ticket in response to a start signal on lines 129, 128 and 127 from the station signal processor 21.

The alternative embodiment of the ticket handling system used in the ticket preparation system shown in FIG. 2 is described with reference to FIGS. 5 and 7. This ticket handling system includes a feeder module 9, a cutter module 10, a printer module and a transport module 13 that are constructed in the same manner as the like-numbered modules described above in relation to the system of FIG. 1. However, the system of FIG. 2 includes a diverter module that includes both an exit position 32 and a capture position 33. The transport module 13 is mechanically interfaced with and between the printer module 11 and the diverter module 25; the printer module 11 is mechanically interfaced with the cutter module 10; and the cutter module 10 is mechanically interfaced with the feeder module 9. The transport module 13 includes fingers 35 for interlocking with fingers 35 of the adjacent modules 11, 25 for effecting mechanical coupling between the modules to provide a continuous aligned, unobstructed passage for the tickets from one module to another.

Figure 5:
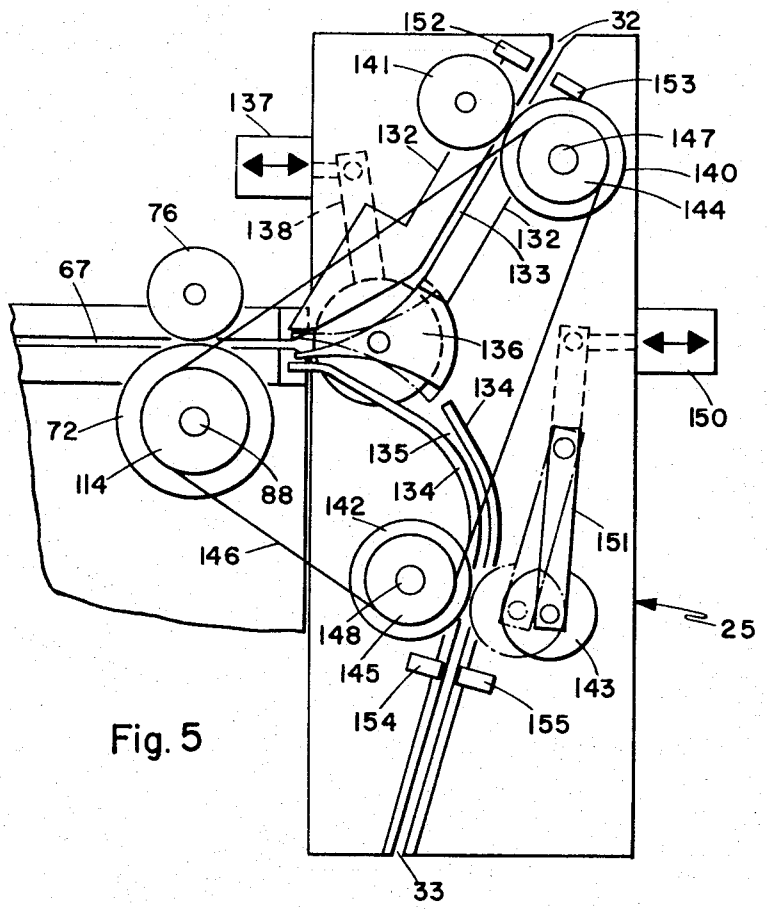
FIG. 5 is a schematic side elevation view of the diverter module included in the ticket handling system of FIG. 2.

Referring to FIG. 5, the diverter module 25 includes structure 132 defining an exit passage 133 for passing a ticket from the transport passage 67 of the transport module 13 to the exit position 32 where the ticket is accessible to a patron. The diverter 25 further includes curved structure 134 defining a capture passage 135 for passing a ticket from the transport passage 67 of the transport module 13 to a capture position 33 where the ticket is inaccessible to the patron.

The diverter module 25 includes a movable diverter 136, which is movable between a first position shown by solid lines and a second position shown by broken lines. When in its first position, the diverter 136 diverts a ticket from the transport passage 67 of the transport module 13 into the exit passage 133 of the diverter module 25. When in its second position, the diverter 136 diverts a ticket from the transport passage 67 of the transport module 13 into the capture passage 135 of the diverter module 25. A diverter solenoid 137 is coupled to the diverter 136 for moving the diverter 136 between its first and second positions. The diverter solenoid 137 is connected to the diverter 136 by linkage 138.

The diverter module 25 includes a drive roller 140 and a corresponding pressure roller 141 for transporting a ticket through the exit passage 133. The diverter module 25 further includes a drive roller 142 and a corresponding pressure roller 143 for transporting a ticket through the capture passage 135. The drive rollers 140 and 142 are coupled by pulleys 144, 145 and 114 and a belt 146 to the axle 88 of the drive rollers 72 of the transport module 13. The pulleys 144 and 145 are on the axles 147 and 148 of the drive rollers 140 and 142, respectively, and the pulley 114 is on the axle 88. Accordingly, the drive rollers 140 and 142 also are driven by the drive motor 77 of the transport module 13.

The pressure roller 143 is movable between first and second positions. When in its first position as shown by broken lines, the pressure roller 143 contacts the drive roller 142 for transporting a ticket through the capture passage 135. When in its second position, as shown by solid lines, the pressure roller 143 is out of contact with the drive roller 142, whereby the ticket is not transported through the capture passage 135 by the rollers 142 and 143; and any ticket in the capture passage 135 at the time the pressure roller 143 is moved to its second position remains in escrow in the capture passage due to contact with the curved structure 134 defining the capture passage 135. An escrow solenoid 150 is coupled to the pressure roller 143 for moving the pressure roller 143 between its first and second positions. The escrow solenoid 150 is connected to the pressure roller 143 by linkage 151.

The diverter module 25 includes a photosensor 152 positioned for sensing the passage of a ticket through the exit passage 133. The diverter module 25 also contains a photosensor 154 for sensing the entry of a ticket into the capture passage 135 and the passage of the ticket through the capture passage 135. LED's 153 and 155 are positioned opposite the photosensors 152 and 154 for providing light beams to the photosensors that are interrupted when a ticket passes between the LED's 153, 155 and the photosensors 152, 154, respectively.

A preferred embodiment of the diverter module 25 is described in the cross-referenced U.S. Pat. No. 4,374,564 issued to Gregory E. Miller and John E. Toth for "Ticket Diverter Module", the disclosure of which is incorporated herein by reference thereto.

The control system 27 includes a feed control circuit 119, a printer transport control circuit 120, a drive control circuit 157, a transducer control circuit 123, and an escrow control circuit 158. These circuits may be located separate from the respective modules containing the components that they control (as shown in FIG. 7), or they may be located in such modules. For example, the feed control circuit 119 can be located in the feeder module 9, the printer transport control circuit 120 can be located in the printer module 11; the drive control circuit 157 and/or transducer control circuit 123 can be located in the transport module 13; and/or the escrow control circuit can be located in the diverter module 25.

Figure 7:
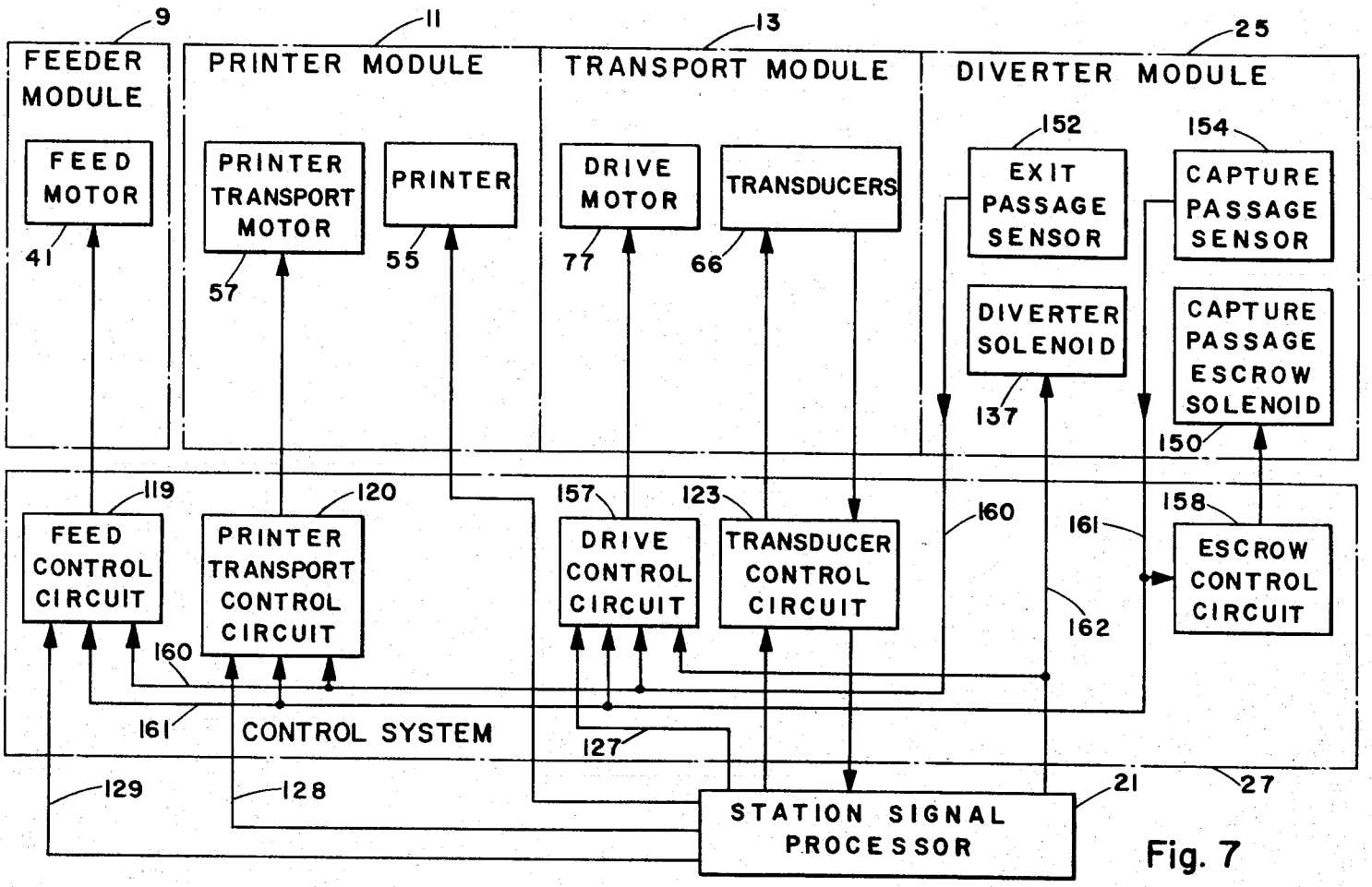
FIG. 7 is a block diagram of that portion of the electrical system of the ticket handling system of FIG. 2 that pertains to the functional cooperation between the different modules of such ticket handling system and with the signal processor.

The control system 27 is shown in FIG. 7 as connected directly to the station signal processor 21, although such connection preferably is made through the local signal processor 17.

The drive control circuit 157 controls the operation of the drive motor 77 in the transport module 13. The drive control circuit 157 receives signals on lines 160 from the exit passage sensor 152 in the diverter module 25; on line 161 from the capture passage sensor 154 in the diverter module 25; and on lines 127 and 162 from the station signal processor 21.

The printer transport control circuit 120 controls the operation of the printer transport motor 57 in the printer module 11. The printer transport control circuit 120 receives signals on line 160 from the exit passage sensor 152 in the diverter module 25; on line 161 from the capture passage sensor 154 in the diverter module 25; and on line 128 from the station signal processor 21.

The feed control circuit 119 controls the operation of the feed motor 41 in the feeder module 9. The feed control circuit receives signals on line 160 from the exit passage sensor 152 in the diverter module 25; on line 161 from the capture passage sensor 154 in the diverter module 25; and on line 129 from the station signal processor 21.

The escrow control circuit 158 controls the operation of the escrow solenoid 150. The escrow control circuit 158 receives a signal on line 161 from the capture passage sensor 154 in the diverter module 25.

The diverter solenoid 137 in the diverter module 25 is controlled in response to a control signal on line 162 from the station signal processor 21 that is fed through the gate control system 27.

The transducer control circuit 123 controls the operation of the transducer 66 in response to signals from the station signal processor 21. The transducer control circuit 123 also provides the write signal from the station signal processor 21 to the transducer head 66; compares the write signal to the read signal, and provides the verification signal to the station signal processor 21 as discussed above with relation to FIG. 1. The particular operation of transducer control circuit 123 will be apparent to those skilled in such art; and an understanding of such operation is not necessary to an understanding of the present invention.

The operation of the ticket handling system of FIG. 7 for a ticket preparation system commences when the feed control circuit 119, the printer transport control circuit 120 and the drive control circuit 157 turn on the feed motor 41, the printer transport motor 57 and the drive motor 77 in response to start signals on lines 129, 128 and 127, respectively, from the station signal processor 21. All three motors 41, 57, 77 initially operate to drive the respective transport systems to which they are coupled so as to transport the ticket stock strip, the ticket blanks and ticket in the forward direction toward the diverter module 25. The feed motor 41 turns off after the cut ticket blank has been fed from the cutter module 10. The printer transport motor 57 is turned off after the printed cut ticket blank has been transported from the printer module 11. Once they have been so turned off, these two motors 41, 57 cannot be turned on again in response to signals on lines 129 and 128 to their respective control circuit 119, 120 until after the control circuits 119, 120 have received an enabling signal on either line 160 from the exit passage sensor 152 or on line 161 from the capture passage sensor 154 indicating that the ticket has either passed through the exit passage 133 of the diverter module 25 and been retrieved by a patron or has passed through the capture passage 135 of the diverter module 25 into the bin 30. This prevents the ticket handling system from becoming jammed by attempting to print and encode more than one ticket at a time.

The printer 55 prints ticket information on the cut ticket blank in response to print signals on line 130 from the station signal processor 21. With the drive motor 77 initially operating in the forward direction, the printed ticket blank is transported in the forward direction past the trasducer head 66 and the ticket is magnetically encoded in response to the write signal from the station signal processor 21.

The ticket is then transported past the transducer head 66 again, and the magnetically encoded signal on the ticket is read by the transducer head 66 to provide a read signal that is provided to the verification circuit in the transducer control circuit 123 and compared to the write signal to thereby produce a verification signal that is provided to the station signal processor 21. It is necessary to transport the ticket back and forth past the transducer head 66 in accordance with the processing of the ticket, and the station signal processor 21 provides signals on line 127 to the drive control circuit 122 to cause the drive motor 77 to be driven in the desired direction for prescribed intervals.

After the signal processing by the station signal processor 21 subsequent to the receipt of the verification signal is completed, the station signal processor 21 provides a signal on line 127 to the drive control circuit 157 to cause the ticket to be transported either in the forward direction from the transport module 13 or into the diverter module 25; and the station signal processor 21 further provides a control signal on line 162 to the diverter solenoid 137 to indicate whether the ticket is to be returned to the patron or captured.

The diverter solenoid 137 responds to the control signal on line 162 by moving the diverter 136 (if it is not already so positioned) to cause the ticket to enter either the exit passage 133 or the capture passage 135.

When the ticket is diverted into the exit passage 133, it is gripped by the transport drive roller 140 and transport pressure roller 141 and transported to the exit position 32, where it may be retrieved by the patron.

When the ticket is diverted into the capture passage it is gripped by the transport drive roller 142 and the transport pressure roller 143 and transported toward the capture position 33.

The capture passage sensor 154 sends a signal on line 161 to the escrow control circuit 158 in response to sensing the passage of the leading edge of the ticket through the capture passage 135. The escrow control circuit 158 responds to such a signal on line 161 by causing the escrow solenoid 150 to move the pressure roller 143 to its second position out of contact with the ticket for a predetermined period, whereupon the transport rollers 142 and 143 are disabled temporarily from further transporting the ticket through the capture passage 135; and the ticket is held in escrow in the capture passage 135.

The signal on line 161 indicating the presence of the ticket in the capture passage 135 also is provided to the drive control circuit 157 where it is processed with the control signal on line 162 from the station signal processor 21 to determine whether the ticket should have been diverted to the capture passage 135. If the ticket should have been diverted to the capture passage 135, the drive control circuit 157 continues to cause the drive motor 77 to be driven in the forward direction, and after the predetermined period, the escrow solenoid 150 moves the pressure roller 143 to its first position in contact with the ticket, whereupon the ticket is transported to the capture position 33 from which it is discharged into the capture bin 30.

However, when the drive control circuit 157 responds to the signals on lines 161 and 162 by determining that a ticket is in the capture passage 135 when it should have been diverted to the exit passage 133, the drive control circuit 157 turns off the drive motor 77 and thereby shuts down the ticket handling system. When the ticket handling system is shut down an indication is provided to the patron by the display 18 that he should seek the assistance of the station attendant for retrieving his ticket. The station attendant then opens the diverter module 25 and removes the ticket from the capture passage 135 and gives it to the patron. Were if not for this system of holding the ticket in escrow within the capture passage 135, it would be necessary for the station attendant to search through the bin 30 to locate a ticket that was erroneously diverted to the capture passage 135.

When the ticket is removed from the exit position 32, it completes its passage through the exit passage 133 in the diverter module 25, and the sensor 152 provides a signal on line 160 to the feed control circuit 119, and the printer transport control circuit 120, and the drive control circuit 122 indicating that the ticket has passed through the exit passage 133 from the transport module 13.

When the ticket passes from the capture position 33, it completes its passage from the capture passage 135 in the diverter module 25 and the sensor 154 provides a signal on line 161 to the feed control circuit 119, the printer transport control circuit 120, and the drive control circuit 122 indicating that the ticket has passed through the capture passage 135 from the transport module 13.

As noted above, the feed control circuit 119 and the printer transport control circuit 120 receive an enabling signal on either line 160 or 161 indicating the passage of the ticket through either the exit passage 133 or the capture passage 135 before being enabled to drive their respective motors 41, 57 in response to another start signal on lines 129 and 128 from the station signal processor 21.

The drive control circuit 157 responds to a signal on either line 160 or 161 indicating the passage of the ticket through either the exit passage 133 or the capture passage 135 by turning off the drive motor 77.

The ticket handling system is again ready for the preparation of another ticket in response to a start signal on lines 129, 128 and 127 from the station signal processor 21.

In other embodiments (not shown) alternative to those shown in FIGS. 6 and 7, a ticket, such as a previously encoded ticket, can be inserted back into the exit passage of the exit module 14 (FIG. 6), or of the diverter module 25 (FIG. 7), and transported to the transport module 13 for encoding. With reference to FIGS. 3 and 6, the entry of a ticket into the exit passage 109 of the exit module 14 from the exit position 24 toward the transport module 13 is sensed by the exit passage sensor 116, and a signal indicating such occurrence is provided on line 125 to the drive control circuit 122. In response to the receipt of such a signal on line 125, the drive control circuit 122 causes the drive motor 77 to drive the transport drive roller 110 in the exit module 4 and the transport drive rollers 69, 70, 71 and 72 in the transport module 13 in the reverse direction to thereby cause the entered ticket to be transported into the transducer module 13 for encoding by the transducer 66.

With reference to FIGS. 5 and 7, the entry of a ticket into the exit passage 133 of the diverter module 25 from the exit position 32 toward the transport module 13 is sensed by the exit passage sensor 152, and a signal indicating such occurrence is provided on line 160 to the drive control circuit 157. In response to the receipt of such a signal on line 160, the drive control circuit 157 causes the drive motor 77 to drive the transport drive roller 140 in the diverter module 25 and the transport drive roller 69, 70, 71 and 72 in the transport module 13 in the reverse direction to thereby cause the entered ticket to be transported into the transport module 13 for encoding by the transducer 66.

We claim:

1. A ticket handling system for use in a ticket preparation system that includes processing means for providing write signals to indicate information to be encoded on tickets; and transducer means for encoding information on tickets in response to said write signals, the ticket handling system comprising:

a feeder module including feed means for feeding a strip of ticket stock until a ticket has been cut from said strip;

a cutter module including cutting means for cutting a ticket of a given length from the fed end of the strip and feeding said cut ticket in a forward direction;

a transport module including the transducer means for accepting and transporting said cut ticket past said transducer means for encoding ticket information on said ticket in response to said write signals; and an exit module mechanically interfaced with the transport module and including means defining an exit passage for passing said ticket from the transport module to an exit position where said ticket is accessible to a patron and sensing means for sensing the passage of said ticket through the exit passage;

wherein the ticket handling system includes control means coupled to the sensing means and the feeder module feed means for enabling the feed means to feed a predetermined length of said strip corresponding to said given length in response to the sensing means sensing the passage of said ticket through the exit passage.

2. A ticket handling system for use in a ticket preparation system that includes processing means for providing write signals to indicate information to be encoded on said tickets; and transducer means for encoding information of tickets in response to said write signals, the ticket handling system comprising a feeder module including feed means for feeding a strip of ticket stock;

a cutter module including cutting means for cutting ticket blanks of a given length from the fed end of the strip;

a transport module including the transducer means for encoding ticket information on the ticket blanks in response to said write signals; and an exit module mechanically interfaced with the transport module and including means defining an exit passage for passing said ticket from the transport module to an exit position where said ticket is accessible to a patron, sensing means for sensing the entry of an encoded ticket into the exit passage from the exit position toward the transport module, and bidirectional transport means for transporting said ticket in either direction through the exit passage; and wherein the ticket handling system includes control means coupled to the sensing means and the transport means for causing said entered ticket to be transported into the transport module for encoding by the transducer means in response to the sensing means sensing said entry of said ticket into the exit passage from the exit position.

3. A ticket handling system for use in a ticket preparation system that includes processing means for providing a write signal to indicate information to be encoded on a ticket; first transducer means for encoding information on a ticket in response to a write signal, second transducer means for reading an encoded ticket and for providing a read signal in response thereto; circuit means for comparing a read signal to a write signal and for providing a verification signal in response to said comparison; and processing means for processing a verification signal and for providing control signals subsequent thereto to indicate whether a ticket is to be passed to an exit position where said ticket is accessible to a parton or to a capture position where said ticket is inaccessible to said patron;

the ticket handling system comprising:

a feeder module including feed means for feeding a strip of ticket stock until a ticket has been cut from said strip;

a cutter module including cutting means for cutting a ticket of a given length from the fed end of the strip;

a transport module including the first transducer means for encoding ticket information on said ticket in response to a write signal, the second transducer means for reading said encoded ticket and for providing a read signal in response thereto, first transport means for transporting said ticket from the transport module, and drive means for driving the first transport means in accordance with given control signals from said processing means; and a diverter module mechanically interfaced with the transport module and including means defining a capture passage for passing said ticket from the transport module to said capture position where said ticket is inaccessible to said patron, means defining an exit passage for passing said ticket from the transport module to said exit position where said ticket is accessible to said patron, and second transport means coupled to and driven by the drive means for transporting said ticket through the diverter module.

4. A ticket handling system according to claim 3, wherein the diverter module further includes, diversion means for diverting said ticket from the transport module into either the capture passage or the exit passage in accordance with given control signals from the processing means.

5. A ticket handling system according to claim 3, wherein the diverter module comprises third transport means for transporting said ticket through the capture passage; and sensing means for sensing entry of said ticket into the capture passage; and wherein the ticket handling system further includes control means coupled to the sensing means and the transport means for disabling the transport means for a predetermined period in response to the sensing means sensing entry of said ticket into the capture passage to thereby cause said ticket to be temporarily held in the capture passage.

6. A ticket handling system according to claim 5, wherein the diverter module further includes diversion means for diverting tickets into the capture passage in accordance with a given control signal from the processing means; and wherein the control means are for coupling to the processing means for receiving said given control signal and are further coupled to said third transport means for preventing said ticket transport means from transporting said ticket to the capture position when entry of said ticket into the capture passage is sensed by the sensing means in the absence of receipt of said given control signal from the processing means.

7. A ticket handling system for use in a ticket preparation system that includes processing means for providing a write signal to indicate information to be encoded on a ticket; first transducer means for encoding information on a ticket in response to a write signal, second transducer means for reading an encoded ticket and for providing a read signal in response thereto; circuit means for comparing a read signal to a write signal and for providing a verification signal in response to said comparison; and processing means for processing a verification signal and for providing control signals subsequent thereto to indicate whether a ticket is to be passed to an exit position where said ticket is accessible to a patron or to a capture position where said ticket is inaccessible to said patron;

the ticket handling system comprising:

a feeder module including feed means for feeding a strip of ticket stock;

a cutter module including cutting means for cutting a ticket of a given length from the fed end of the strip;

a transport module including the first transducer means for encoding ticket information on said ticket in response to a write signal and the second transducer means for reading said encoded ticket and for providing a read signal in response thereto; and a diverter module mechanically interfaced with the transport module and including means defining a capture passage for passing said ticket from the transport module to said capture position where said ticket is inaccessible to said patraon, means for defining an exit passage for passing said ticket from the transport module to said exit position where said ticket is accessible to said patron, and diversion means for diverting tickets from the transport module into either the capture passage or the exit passage in accordance with given control signals fom the processing means.

8. A ticket handling system according to claim 7, wherein the diverter module comprises, transport means for transporting said ticket through the capture passage; and sensing means for sensing entry of said ticket into the capture passage; and wherein the ticket handling system further includes control means coupled to the sensing means and the transport means for disabling the transport means for a predetermined period in response to the sensing means sensing entry of said ticket into the capture passage to thereby cause said ticket to be temporarily held in the capture passage.

9. A ticket handling system according to claim 8, wherein the diversion means is adapted for diverting tickets into the capture passage in accordance with a first given control signal from the processing means; and wherein the control means are for coupling to the processing means for receiving said first given control signal and are further coupled to said transport means for preventing said transport means from transporting said ticket to the capture position when entry of said ticket into the capture passage is sensed by the sensing means in the absence of receipt of said first given control signal from the processing means.

* * * * *

UNITED STATES PATENT AND TRADEMARK OFFICE

CERTIFICATE OF CORRECTION

PATENT NO. : 4,535,892

DATED : August 20, 1985

INVENTOR(S) : JOHN B. ROES, GUY M. KELLY, ROBERT F. CASE AND CHANDLER R. DEMING

It is certified that error appears in the above-identified patent and that said Letters Patent are hereby corrected as shown below:

Claim 2, column 16, line 23, change the word "of" to --on--.

Claim 7, column 18, line 27, change the word "patraon" to --patron--.

Claim 7, column 18, line 34, change the word "fom" to --from--.

Signed and Sealed this

*Twenty-eighth* Day of *January 1986*

[SEAL]

*Attest:*

DONALD J. QUIGG

*Attesting Officer*

*Commissioner of Patents and Trademarks*